United States Patent [19]

Tinnes et al.

[11] Patent Number: 4,966,315

[45] Date of Patent: Oct. 30, 1990

[54] REFRACTORY PLATE ASSEMBLY FOR A THREE-PLATE SLIDING CLOSURE UNIT

[75] Inventors: Bernhard Tinnes, Zollikerberg; Walter Vetterli, Winterthur, both of Switzerland

[73] Assignee: Metacon AG, Zurich, Switzerland

[21] Appl. No.: 400,056

[22] Filed: Aug. 29, 1989

[30] Foreign Application Priority Data

Aug. 31, 1988 [EP] European Pat. Off. ..... 88114176

[51] Int. Cl.[5] ..... B22D 41/08

[52] U.S. Cl. ..... 222/600; 266/236

[58] Field of Search ..... 222/590, 591, 600; 266/271, 236

[56] References Cited

U.S. PATENT DOCUMENTS

| | | | |
|---|---|---|---|
| 3,436,023 | 4/1969 | Thalmann | 222/600 |
| 3,712,518 | 1/1973 | Meier | 222/600 |
| 4,257,543 | 3/1981 | Muschner et al. | 222/600 |

FOREIGN PATENT DOCUMENTS

| | | | |
|---|---|---|---|
| 0260444 | 3/1968 | Austria | 222/600 |
| 1910247 | 9/1970 | Fed. Rep. of Germany . | |
| 2083566 | 12/1971 | France . | |
| 2433384 | 3/1980 | France . | |
| 1515922 | 6/1978 | United Kingdom . | |

*Primary Examiner*—S. Kastler

*Attorney, Agent, or Firm*—Wenderoth, Lind & Ponack

[57] ABSTRACT

An assembly of refractory plates for a three-plate sliding closure unit includes an inlet stationary refractory plate having therethrough an outlet opening, an outlet stationary refractory plate having therethrough an outlet opening, and a movable refractory plate mounted between the inlet and outlet stationary plates and having an outlet opening. The movable plate is slidable relative to the stationary plates between closed, open and throttled positions. The axis of the outlet opening in the outlet stationary plate is offset in a closing direction of movement of the movable plate from the axis of the outlet opening in the inlet stationary plate. The inlet end of the outlet opening in the outlet stationary plate is widened.

8 Claims, 2 Drawing Sheets

REFRACTORY PLATE ASSEMBLY FOR A THREE-PLATE SLIDING CLOSURE UNIT

BACKGROUND OF THE INVENTION

The present invention relates to an assembly of refractory plates for use in a three-plate sliding closure unit for controlling the discharge of molten metal from a metallurgical vessel, for example from an intermediate vessel such as a tundish into the mold of a continuous casting plant. More particularly, the present invention relates to such a refractory plate assembly including inlet and outlet stationary refractory plates having aligned respective outlet openings and a movable refractory plate positioned between the two stationary refractory plates and having an outlet opening that is moved into and out of alignment with the outlet openings in the two stationary refractory plates. The outlet stationary refractory plate carries a refractory outlet, for example in the form of a pouring tube or an outlet sleeve. Also, the outlet opening in the outlet stationary refractory plate enables complete draining of molten metal within the outlet opening of the movable plate during movement of the movable plate in a closing direction to a closed position.

Sliding closure units of the three-plate type are employed, as is known, primarily to control the quantity of molten metal to be introduced into a continuous casting mold from an intermediate vessel such as a tundish. During the casting operation, the starting point for control of the discharge of the molten metal is a choke position whereat the movable plate partially blocks or restricts the discharge channel formed of the outlet openings in the three plates. In this manner, control of the cross sectional area of the discharge channel is possible not only in the closing direction of movement of the movable plate, but also in the opening direction of movement of the movable plate. There is one exception to the choke position that normally is at the start of a casting operation when the discharge channel is completely open. In known arrangements the outlet openings in the inlet and outlet stationary plates are positioned in complete alignment so as to be coincident, and also the outlet opening in the movable plate in the open position is coincident with the outlet openings in the stationary plates. During positioning of the movable plate in a choke position, a choking edge of the movable plate is between the outlet openings in the stationary plates and projects into and restricts the cross sectional area of the discharge channel. This causes a sharp redirecting of the discharging stream of molten metal in the discharge channel, such redirected or deflected stream of molten metal extending in the closing direction of movement of the movable plate. The result of such a sharp deflection of the discharge stream is increased flow pressures, particularly below the movable plate at the edge of the outlet opening of the outlet stationary plate that lies in the flow path and in the drainage region, i.e. in the pouring tube or outlet sleeve, therebeneath. In such regions the refractory materials of the plates are subject to exceptionally high thermal and erosive stresses, thus subjecting the plates to undesirable high degrees of accelerated wear. This in turn necessitates the premature replacement of such plates. In addition, deposits from the molten metal, which increasingly restrict the discharge channel, occur primarily at the edge of the outlet opening in the outlet stationary plate that lies in the flow path due to turbulence of flow of the discharge stream.

German No. DE-PS No. 28 36 434 discloses a three-plate sliding closure unit having a discharge nozzle designed, not with respect to the flow conditions within the discharge channel, but with respect to the outlet opening in the outlet stationary plate. Particularly, such outlet opening is designed as an elongated opening extending in the closing direction of the movable plate to ensure that all molten metal within the outlet opening in the movable plate will completely drain therefrom during a closing operation. However, the production of such elongated outlet openings is time consuming and difficult. This particularly is true in refractory plates wherein the elongated outlet opening must be fitted to the inlet cross section of an attachable pouring tube. Also, an outlet stationary plate with an elongated outlet opening, the cross section of which is greater than the cross section of the other outlet openings of the assembly, is significantly weakened, primarily with respect to flexural strength.

SUMMARY OF THE INVENTION

With the above discussion in mind, it is the object of the present invention to provide an improved assembly of refractory plates for use in a three-plate sliding closure unit, whereby it is possible to avoid the above and other prior art disadvantages. It is a more particular object of the present invention to provide such a refractory plate assembly whereby it is possible to improve the flow characteristics of the discharged molten metal within the refractory plate assembly when such assembly is in the choke position, and at the same time to provide the plates of such assembly with a relatively high service life.

The above and other objects of the present invention are achieved by the provision that the axis of the outlet opening in the outlet stationary plate is offset in the closing direction of the movable plate from the axis of the outlet opening in the inlet stationary plate, and that the inlet end of the outlet opening in the outlet stationary plate is widened. These improved features of the present invention can be provided without any significant changes in normal manufacture of the plates. At the same time, the strength of the plates is not lessened, and particularly the flexural or bending strength of the plates is not lessened. Furthermore, by the above features of the present invention, there are created conditions within the discharge channel causing less wear and erosion of the edges of the plates due to the flow of the molten metal stream. Particularly, the flow of the molten metal stream through the discharge channel in the choke position of the assembly substantially is unimpeded, particularly compared to the conventional assembly. Thus, with a relatively low construction cost it is possible to achieve high efficiency and service life of the outlet stationary plate and of the outlet member attached thereto. The service life of both of these components is significantly increased compared to conventional assemblies. Also, both of these components remain largely unimpeded by deposits from the molten metal.

In a particularly preferred embodiment of the present invention, the dimension of the offset of the longitudinal axes of the inlet and outlet stationary refractory plates is 10 to 15% of the dimension, for example diameter, of the outlet opening in the inlet stationary plate.

The widened inlet end of the outlet opening in the outlet stationary plate is defined by at least one surface inclined to the axis of the outlet opening in the outlet stationary plate. Such inclined surface may be a conical surface. Such inclined surfaces may be provided on opposite sides of the outlet opening of the outlet stationary plate in the direction of movement of the movable plate. Alternatively, there may be provided a single inclined surface located on a side of the outlet opening in the outlet stationary plate in the direction of movement of the movable plate to the open position. Both such arrangements readily can be achieved, for example by mounting an eccentric machine part, for example a bit or grinding wheel, at an angle to the edge of the outlet opening. This will result in outlet stationary plates having good strength properties. Preferably the dimension of the widening of the inlet end of the outlet opening in the outlet stationary plate is at least equal to the dimension of the offset of the axes of the two stationary plates. In accordance with a further embodiment of the present invention, the dimension in the closing direction of the outlet opening in the outlet stationary plate may be less than the dimension in the closing direction of the outlet opening in the inlet stationary plate by an amount no more than twice the dimension of the offset of the axes of the two stationary plates.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
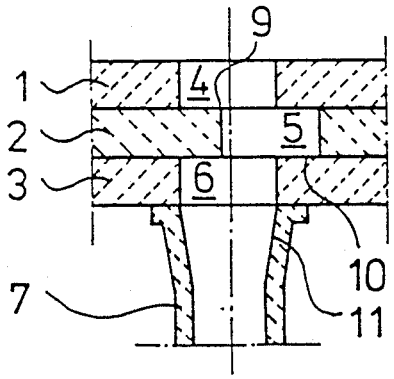
Fig. 1 PRIOR ART
FIG. 1 is a fragmentary longitudinal sectional view of a known assembly of refractory plates for use in a three-plate sliding closure unit, shown in a choke position.

FIG. 1 shows a known assembly of refractory plates for use in a three-plate sliding closure unit for controlling the discharge of molten metal from a metallurgical vessel (not shown) through an outlet pipe 7, for example an immersion pipe, into a continuous casting mold (also not shown). This known assembly includes upper or inlet stationary refractory plate 1 having therethrough discharge opening 4, lower or outlet stationary refractory plate 3 having therethrough outlet opening 6, and movable refractory plate 2 mounted between plates 1 and 3 and having discharge opening 5. Movable plate 2 is movable in closing and opening directions, respectively to the right and to the left with respect to the arrangement of FIG. 1, to move plate 2 between an entirely open position whereat opening 5 is completely in line with and in communication with openings 4 and 6, and a closed position, whereat opening 5 is completely out of communication with openings 4 and 6. The prior art arrangement shown in FIG. 1 is illustrated in a choke or throttled position whereat the opening 5 is partially in communication with opening 4 and also partially in communication with opening 6. This position restricts the cross-sectional area of a discharge channel formed by openings 4–6 in controlling the discharge of the molten metal. The control of the cross-sectional area of the discharge channel can be adjusted by movement of the plate 2 in an opening direction, i.e. to the left in FIG. 1, and in a closing direction, i.e. to the right in FIG. 1. Thus, plate 2 may assume all possible choke or throttle positions ranging from the completely open position to the completely closed position. This may be done in order to maintain, for example, a desired filling level in a continuous casting mold. The approximately half throttle or choke position shown in FIG. 1 is a normal starting position for a discharge operation, since from such throttle position it is possible to achieve opening control equally in either of the opening and closing directions.

In such a choke or throttled position, the molten metal stream through the discharge channel is sharply deflected at a projecting edge 9 of plate 2. The flow or deflection pressure of the molten metal stream forms an eddy current acting primarily on an edge 10 of plate 3 that extends in the closing direction and on an area 11 of the outlet pipe 7 that lies therebeneath. This arrangement results in a condition causing accelerated wear of the refractory materials, and this has a negative impact of the service life of the outlet plate 3 and the outlet pipe 7.

In accordance with the present invention however, the above disadvantages are overcome. For example, in the embodiment of the present invention illustrated in FIGS. 2 and 3, the outlet opening 12 of the outlet stationary plate 3 is no arranged coincident with the outlet opening 4 of the inlet stationary plate 1. Rather, the axis of the outlet opening 12 is offset by a dimension or distance X in the closing direction 8 of the movable plate 2 relative to the axis of outlet opening 4. As a result, when the movable plate 2 is in the choke or throttle position, illustrated by broken lines in FIG. 2, the molten metal stream is passed almost directly into outlet pipe 7, thereby avoiding accelerated erosion and wear at positions such as 10 and 11 in the conventional arrangement shown in FIG. 1. In other words, in the arrangement of the embodiment of FIG. 2 there is no surface 10 exposed to such wear. Also, there is no sharp deflection of the flow stream and thus an area corresponding to 11 in FIG. 1 does not occur in the arrangement of FIG. 2. Additionally, the outlet openings 4, 5, 12 to a large extent are not impeded by the formation of deposits that tend to plug or restrict the discharge channel during a casting operation. This particularly is true when the movable plate 2 is moved to the closed position (indicated by 13 in dashed lines in FIG. 3) and as a result all molten metal within outlet opening 5 will completely drain to outlet opening 12 during movement of plate 2 to the closed position, 13 in FIG. 3 illustrating the position of opening 5 in the closed position.

Figure 2:
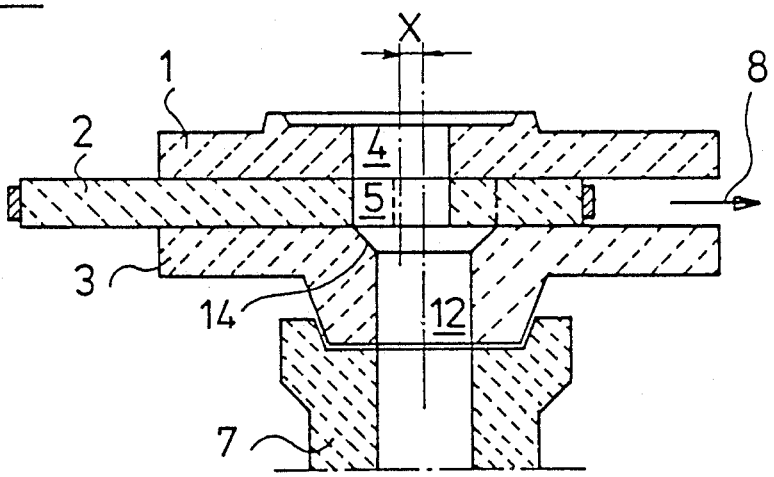
FIG. 2 is a longitudinal sectional view through an assembly of refractory plates in accordance with the present invention, shown in an open position thereof.
Figure 3:
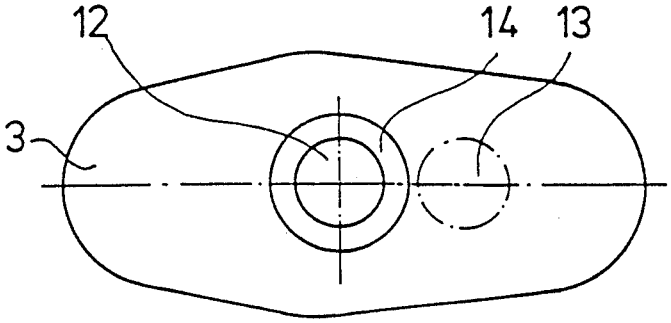
FIG. 3 is a plan view of an outlet stationary plate of the assembly of FIG. 2.

In further accordance with the present invention, the inlet end of the outlet opening 12 is widened, as indicated at 14 in FIGS. 2 and 3. In this embodiment, such widening is conical and defined by a surface inclined to the axis of opening 12. This widening also can be of an elongated conical shape.

Figure 4:
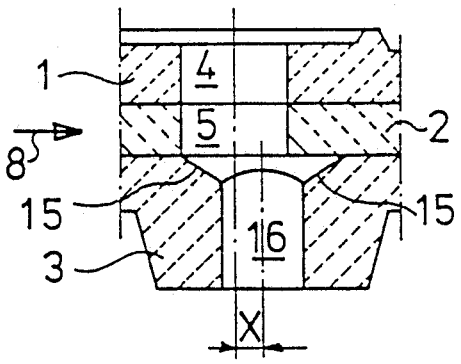
FIG. 4 is a partial view similar to FIG. 3 but of another embodiment of the present invention.
Figure 5:
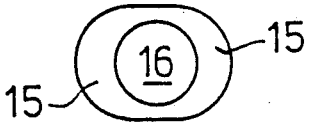
FIG. 5 is a plan view illustrating the configuration of an outlet opening in an outlet stationary plate of FIG. 4.
Figure 6:
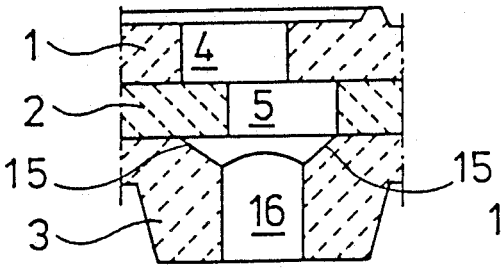
FIG. 6 is a view similar to FIG. 4 but showing the assembly thereof in a choke position.

In the embodiment of FIGS. 4–6, the widening of the inlet end of the outlet opening 16 in plate 3 is not only conical, but also elongated, as indicated at 15, on opposite sides of outlet opening 16 in the direction of movement of movable plate 2. Also, this embodiment illustrates another feature of the present invention wherein the dimension in the closing direction of outlet opening 16 is less than the dimension in the closing direction of outlet opening 4 in plate 1. This difference in dimension, i.e. diameter, is no more than twice the dimension of the offset X. The dimension, i.e. diameter, of outlet opening 16 is smaller than the corresponding dimension, i.e. diameter, of outlet openings 4 and 5 to consolidate the discharged stream. Even in this embodiment however the flow path of the molten metal in the choke position, as shown in FIG. 6, will be essentially deflection-free.

Figure 7:
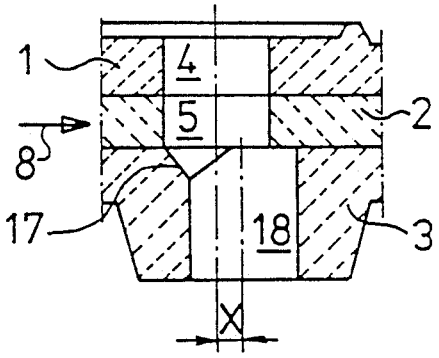
FIG. 7 is a view similar to FIG. 4 but of a further embodiment of the present invention.
Figure 8:
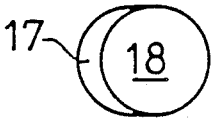
FIG. 8 is a view similar to FIG. 5 but indicating the configuration of the outlet opening in the embodiment of FIG. 7.
Figure 9:
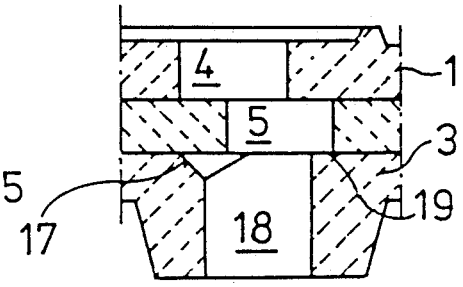
FIG. 9 is a view similar to FIG. 7 but showing the assembly thereof in a choke position.

In the embodiment of FIGS. 7–9 the widening 17 of the inlet end of outlet opening 18 in plate 3 is located on one side only of outlet opening 18, namely in the direction of movement of movable plate 2 to the open position thereof. Even in this embodiment, the projecting edge 19 of the outlet stationary plate 3 that is exposed to the discharged stream will be relatively small, and substantially smaller than the edge surface 10 of the prior art arrangement shown in FIG. 1.

In the above embodiments of the present invention, the dimension of the widening 14, 15, 17 preferably is at least equal to the dimension of offset X.

The above embodiments of the invention have been described with respect to a continuous casting system. However, the present invention equally is effective for other types of operations, for example casting operations wherein, rather than an immersion pipe 7, an outlet sleeve is attached to plate 3.

Although the present invention has been described and illustrated with respect to preferred features thereof, it is to be understood that various modifications and changes may be made to the specifically described and illustrated features without departing from the scope of the present invention.

We claim:

1. In an assembly of refractory plates for use in a three-plate sliding closure unit for controlling the discharge of molten metal from a metallurgical vessel, said assembly including an inlet stationary refractory plate having therethrough an outlet opening to receive molten metal from the metallurgical vessel, an outlet stationary refractory plate having therethrough an outlet opening and fixedly positioned relative to said inlet stationary refractory plate, and a movable refractory plate mounted between said inlet and outlet stationary plates and having an outlet opening, said movable plate being slidable relative to said inlet and outlet stationary plates between a closed position, whereat said outlet opening of said movable plate is blocked from communication with said outlet openings of said inlet and outlet stationary plates, a completely open position, whereat said outlet opening of said movable plate is completely open to communication with said outlet openings of said inlet and outlet stationary plates, thereby defining a discharge channel for the discharge of molten metal, and throttled positions between said closed and open positions, whereat said outlet opening in said movable plate is partially in communication with said outlet opening in said inlet stationary plate, thereby restricting the cross-sectional area of said discharge channel and controlling the discharge of the molten metal, said movable plate being movable in a closing direction from said open position to said closed position, and said outlet opening in said outlet stationary plate enabling complete draining of molten metal within said outlet opening in said movable plate during movement of said movable plate in said closing direction to said closed position, the improvement wherein:

the axis of said outlet opening in said outlet stationary plate is offset in said closing direction from the axis of said outlet opening in said inlet stationary plate; and the inlet end of said outlet opening in said outlet stationary plate is widened.

2. The improvement claimed in claim 1, wherein the dimension of said offset is 10 to 15% of the dimension in said closing direction of said outlet opening in said inlet stationary plate.

3. The improvement claimed in claim 1, wherein said widened inlet end of said outlet opening in said outlet stationary plate is defined by at least one surface inclined to said axis of said outlet opening in said outlet stationary plate.

4. The improvement claimed in claim 3, wherein said inclined surface comprises a conical surface.

5. The improvement claimed in claim 3, wherein a said inclined surface is provided on opposite sides of said outlet opening of said outlet stationary plate in the direction of movement of said movable plate.

6. The improvement claimed in claim 3, comprising a single said inclined surface located on a side of said outlet opening in said outlet stationary plate in the direction of movement of said movable plate to said open position.

7. The improvement claimed in claim 1, wherein the dimension of said widening of said inlet end of said outlet opening in said outlet stationary plate is at least equal to the dimension of said offset.

8. The improvement claimed in claim 1, wherein the dimension in said closing direction of said outlet opening in said outlet stationary plate is less than the dimension in said closing direction of said outlet opening in said inlet stationary plate by an amount no more than twice the dimension of said offset.

* * * * *